United States Patent [19]

Taniguchi et al.

[11] 4,390,339

[45] Jun. 28, 1983

[54] METHOD FOR REMOVAL OF FUNGI FORMED ON HIDES

[75] Inventors: Tokuyuki Taniguchi, Chiba; Iwao Yashima, Funabashi; Masanori Ota, Ichikawa; Hitoshi Sasahara, Narashino, all of Japan

[73] Assignee: Nissan Chemical Industries, Ltd., Tokyo, Japan

[21] Appl. No.: 361,430

[22] Filed: Mar. 24, 1982

[30] Foreign Application Priority Data

Apr. 1, 1981 [JP] Japan ..... 56-48835
Nov. 20, 1981 [JP] Japan ..... 56-186454

[51] Int. Cl.[3] ..... C14C 1/00; D06L 3/06

[52] U.S. Cl. ..... 8/94.18; 8/94.15; 8/108 R

[58] Field of Search ..... 8/94.18, 94.15, 108 R

[56] References Cited

U.S. PATENT DOCUMENTS 1,596,471 8/1926 Wesenberg ..... 8/94.18
2,172,233 9/1939 Wilson ..... 8/94.15
2,998,293 8/1961 Damm et al. ..... 8/94.18
3,450,483 6/1969 Nordstrom ..... 8/94.15
3,919,103 11/1975 Berkowitz ..... 8/108 R

*Primary Examiner*—Maria Parrish Tungol
*Attorney, Agent, or Firm*—Parkhurst & Oliff

[57] ABSTRACT

Fungi growing on a hide are removed by immersing the hide in an aqueous solution of chlorinated isocyanuric acid or salt in a solution of chlorinated isocyanuric acid or salt in a halogenide of an aliphatic hydrocarbon having one to three carbon atoms or in a ketone or ester represented by the general formula:

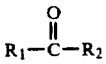

(wherein, $R_1$ denotes an alkyl group having one to three carbon atoms and $R_2$ an alkyl group or alkoxy group having one to three carbon atoms).

10 Claims, No Drawings

METHOD FOR REMOVAL OF FUNGI FORMED ON HIDES

BACKGROUND OF THE INVENTION

1. Field of the Invention

This invention relates to a novel method for the removing of fungi from hides, particularly wet hides, suffering from fungous growth prior to the step of vegetable tanning in the process of the manufacture of leather.

2. Description of Prior Art

The method heretofore used for the removal of fungi stealing growth on hides which are undergoing processing for the manufacture of leather has comprised treating the affected hides with a chlorine agent such as, for example, sodium chlorite or sodium hypochlortie, thereby destroying the fungi in growth. This method, though capable of eradicating the fungi, is incapable of eliminating the discoloration caused in the texture of hides in consequence of the fungous growth. Further, a large amount of yellow chlorine gas is liberated during the treatment of the hides with the chlorine agent. This treatment, therefore, proves undesirable as a step in the process of the commercial manufacture of leather. It is known that the hides prior to vegetable tanning are rendered less susceptible to fungous growth when they are dried and stored in a dehydrated state. This method calls for an extra step of drying. When the hides thus dried are inadvertently handled, particularly so as to be folded, they will possibly sustain discolored streaks or patterns along the portions roughly handled or folded and will often undergo early degradation. This method is likewise unsuitable for inclusion as a step in the process of the commercial manufacture of leather.

Under the present state of the art, the practice of inevitably discarding hides which suffer from heavy fungous growth still prevails.

SUMMARY OF THE INVENTION

An object of this invention is to provide a novel method for the removal of fungi from hides suffering from fungous growth prior to the step of vegetable tanning. A further object of this invention is to provide a method for the removal of fungi from hides suffering from fungous growth, which method effects the removal of fungi in such a manner that the hides will be neither directly degraded and discolored in texture nor indirectly caused to undergo any adverse effects upon the subsequent steps of vegetable tanning, dyeing, fattening, drying, etc., but will be finished into leather of high quality. Another object of the invention is to provide a method for the removal of fungi from hides suffering from fungous growth, which method effects the fungous removal safely without entailing generation of any noxious matter such as chlorine gas.

DETAILED DESCRIPTION OF THE INVENTION

This invention relates to a method for the removal of fungi from hides, particularly wet hides, suffering from fungous growth prior to the step of vegetable tanning in the process of the manufacture of leather.

Generally, leather is manufactured through the finishing steps of vegetable tanning, fattening, dyeing, drying, etc. In the steps preceding the vegetable tanning, namely, the steps of raw hide separation, liming, drying, resoaking, dehairing, deliming, enzymatic decomposition, pickling, chrome tanning, and neutralization, particularly between the chrome tanning and the vegetable tanning, the hides under treatment are left standing in wet states containing 70 to 80 percent of water, for example. While so standing, they often suffer from growth of fungi such as those referred to as red fungi and blue fungi. The fungous growth causes degradation of quality in produced leather. At times, the fungous growth is such that when hides suffering from the fungous growth are subjected to vegetable tanning and dyeing, such phenomena as uneven dyeing, fading, and degradation will ensue to divest the finished leather of its economic value.

The inventors have found that when hides suffering from fungous growth are left standing in an aqueous solution of chlorinated isocyanuric acid or salt or a solution of chlorinated isocyanuric acid or salt in an organic solvent such as, for example, a hydrocarbon halogenide, a ketone, or an ester, the fungi are completely destroyed and the discoloration caused in the textures of hides by the fungi is completely wiped out. Furthermore, during the standing of the hides in the solution, no liberation of chlorine gas occurs and the consumption of chlorinated isocyanuric acid or salt in the solution is very small.

Examples of chlorinated isocyanuric acids and salts which are effectively usable in this invention include trichloroisocyanuric acid, dichloroisocyanuric acid, sodium dichloroisocyanurate, potassium dichloroisocyanurate, calcium dichloroisocyanuric acid, anhydrous salts of such alkali metal salts and alkaline earth metal salts, water-containing salts of such metal salts, and mixtures thereof.

The chlorinated isocyanuric acids are obtained by chlorinating cyanuric acids. Depending on the degree of this chlorination, the product of chlorination is either dichloroisocyanuric acid or trichloroisocyanuric acid. These chlorination products are sparingly soluble in water. To be used conveniently, therefore, dichloroisocyanuric acid is rendered soluble in water by conversion into alkali metal salts. Since trichlorocyanuric acid is incapable of forming a metal salt, it is converted into a solution in an organic solvent to ensure convenience of use.

Of the solutions effectively usable in the method of this invention, the aqueous solution of chlorinated isocyanuric acid is easily obtained by dissolving in water one member selected from the group consisting of commercially available industrial chemicals including anhydrous salts and hydrated salts of alkali metal salts of dichloroisocyanuric acid and mixtures of such salts. The organic solvent solution is obtained by dissolving one member selected from the group consisting of: free acid such as trichloroisocyanuric acid and dichloroisocyanuric acid; alkali metal salts and alkaline earth metal salts such as sodium dichloroisocyanurate, potassium dichloroisocyanurate, calcium dichloroisocyanurate, and anhydrous and hydrated salts of the alkali metal salts and alkaline earth metal salts, and mixtures thereof, either in a halogenide of an aliphatic hydrocarbon having one to three carbon atoms or in a ketone or ester of the following general formula:

$$R_1-\overset{\overset{\displaystyle O}{\|}}{C}-R_2$$

(wherein $R_1$ denotes an alkyl group having 1 to 3 carbon atoms such as, for example, methyl, ethyl or propyl group, and $R_2$ denotes the same alkyl group as described above or an alkoxy group having 1 to 3 carbon atoms such as, for example, methoxy, ethoxy, or propoxy group).

Examples of the halogenide of an aliphatic hydrocarbon of 1 to 3 carbon atoms effectively useable in the method of this invention include chloroform, carbon tetrachloride, tetrachloroethylene, tetrachloroethane, and dichloropropane. Examples of the ketone or ester effectively usable in the method of this invention include acetone, methylethyl ketone, diethyl ketone, methyl acetate, ethyl acetate, and propyl acetate.

To be used effectively for the removal of fungi growing in hides, the aqueous solution or the solution in an organic solvent described above is prepared so that it will contain active chlorine in a concentration of about 0.01 to 20 percent, preferably 0.1 to 10 percent. The solution of a chlorinated isocyanuric acid or salt (the expression "solution" is hereinafter used to designate the aqueous solution and the solution in an organic solvent collectively), on contact with hides, liberates a fungicidally active chlorine such as in the form of hypochlorous acid and exhibits a powerful fungicidal activity without giving rise to noxious gases such as chlorine gas.

The solution of a chlorinated isocyanuric acid or salt to be used in the method of this invention may have any substance dissolved or contained therein in addition to the aforementioned chlorinated isocyanuric acid or salt in so far as the solution is capable of fulfilling the objects of this invention. For efficient removal of fungi from the hides, for example, the aqueous solution may be desired to have a nonionic surfactant, an anionic surfactant, etc., dissolved therein in conjunction with the chlorinated isocyanuric acid or salt. Examples of suitable surfactants include polyoxyethylene alkyl ethers, polyoxyethylene alkylphenol ethers, polyoxyethylene fatty acid esters, sorbitan fatty acid esters, polyoxyethylene sorbitan fatty acid esters, and glycerin fatty acid esters which can be added to the aqueous solutions and the solutions in organic solvents. Other examples of suitable surfactants include oxyethylene-oxypropylene block polymer, metal salts of fatty acids, alkyl sulfuric acid ester salts, alkylbenzene sulfonic acid salts, alkylnaphthalene sulfonic acid salts, dialkylsulfosuccinic acid ester salts, and polyoxyethylene alkylsulfonic acid ester salts which can be added to the aqueous solutions.

In accordance with this invention, the treatment of hides suffering from fungous growth by the solution of the chlorinated isocyanuric acid or salt is effected by immersing the hides in the solution of chlorinated isocyanuric acid or salt, by spraying the solution of chlorinated isocyanuric acid or salt on the surface of the hides, or by any of the other oridnary methods available for bringing the hides into contact with the solution of chlorinated isocyanuric acid or salt. As mentioned above, when the solution of chlorinated isocyanuric acid or salt is held in contact with the hides suffering from fungous growth, the active chlorine of the chlorinated isocyanuric acid or salt is gradually spent. For this solution to provide the treatment effectively, therefore, the chlorinated isocyanuric acid or salt is generally desired to be dissolved in water or in the organic solvent in a concentration of at least 0.01 part by weight, preferably in a concentration of about 0.1 to 10 parts by weight, as active chlorine based on 100 parts by weight of hides having a water content of 70 to 80 percent. The temperature for this treatment is desirably room temperature, preferably above 10° C. At this temperature, the treatment is desired to be carried out generally for a period of several minutes to several hours. Particularly for efficient contact with the hides, the solution of chlorinated isocyanuric acid is desirably kept in a flowing state. Thus, the removal of fungi from the hides is facilitated by immersing the hides in the solution of chlorinated isocyanuric acid or salt which is kept in a stirred state.

The advantages of the present invention are as enumerated below:

(1) The chlorinated isocyanuric acid or salt as the raw material to be used in the preparation of the solution for the treatment, and the chlorinated hydrocarbon, ketone or ester to be used as the solvent are easily obtained at low prices;

(2) The removal of fungi from hides can be effected by a simple operation;

(3) The treatment given to the hides for the removal of fungi does not cause any damage, alteration of quality, or discoloration; and (4) The treatment has no possibility of producing a noxious gas harmful to the human system.

Now, the method of this invention will be described more specifically below with reference to working examples.

EXAMPLE 1

From a hide 3 mm in thickness having red fungi growing throughout the entire surface, rectangles 3 cm × 4 cm in area were cut out to be used as test pieces. Four of the test pieces were immersed in 100 ml of an aqueous chlorinated isocyanuric acid solution at 35° C. for 60 minutes, with the solution kept in a stirred state. With respect to chloramine gas liberated during the treatment, the amount of chloramine liberated was determined by collecting the liberated chloramine absorbed in an aqueous ortho-toluidine hydrochloride solution and measuring the degree of yellowness of the aqueous solution in terms of the absorbance of light at a wavelenth of 440 mμ with a spectrophotomer. At the end of the treatment described above, the aqueous solution was assayed for residual active chlorine and the test pieces were washed for five minutes with water and visually examined to evaluate the degree of discoloration caused by fungi. Further, three test pieces were subjected to a treatment for the extraction of fungi by the true-fungi culture test method (in accordance with the paragraph "test of microorganisms," in the Method for Hygienic Test edited by The Pharmaceutical Society of Japan, published by Kanehara Publishing Company, p. 130 to 138, (1980)) at 25° C. for one week. At the end of the treatment, a count was taken of fungi surviving on the test pieces. The results are collectively shown in Table 1.

EXAMPLE 2

The procedure of Example 1 was repeated, except that an acetone solution of chlorinated isocyanuric acid was used in place of the aqueous chlorinated isocyanuric acid. The results are also shown in Table 1.

COMPARATIVE EXPERIMENT 1

Test pieces of a hide suffering from fungous growth were treated by following the procedure of Example 1, except that sodium hypochlorite was used in place of chlorinated isocyanuric acid. Other test pieces of the same hide were treated with water. The results are shown in Table 1.

TABLE 1

| Example | Test Run No. | Active chlorine concentration in treating solution (ppm) | Discoloration by fungi after treatment (*2) | Count of fungi after treatment (*1) | Amount of chlorine remaining in solution after treatment (ppm) | Amount of chloramine liberated during treatment (mg) |
|---|---|---|---|---|---|---|
| Example 1. | 1 | Sodium dichloroisocyanurate, 3,000 | ○ | 0 | 1,600 | 0.6 |
| | 2 | Sodium dichloroisocyanurate, 10,000 | ◎ | 0 | 8,000 | 2.3 |
| | 3 | Potassium dichloroisocyanurate, 3,000 | ○ | 2 | 1,500 | 0.4 |
| | 4 | Potassium dichloroisocyanurate, 10,000 | ◎ | 0 | 7,700 | 2.1 |
| Example 2. | 5 | Trichloroisocyanuric acid, 5,000 | ◎ | 0 | 4,000 | 1.3 |
| | 6 | Same as test run 5, 10,000 | ◎ | 0 | 7,200 | 4.6 |
| | 7 | Dichloroisocyanuric acid, 5,000 | ◎ | 1 | 3,800 | 1.1 |
| | 8 | Same as test run 7, 10,000 | ◎ | 0 | 6,100 | 5.0 |
| Comparative Experiment | 9 | Sodium hypochlorite, 3,000 | Δ | 44 | 90 | 9.8 |
| | 10 | Same as test run 9, 10,000 | Δ | 5 | 1,100 | 49.5 |
| | 11 | None | X | $2 \times 10^5$ | — | — |

Note:
(*1) Number of fungi remaining on one test piece after treatment
(*2) ○: Total absence of discernible discoloration
◎: slight discoloration
Δ: Fair discoloration
X: Heavy discoloration As shown in Table 1 above, absolutely no discernible discoloration was observed and an extremely small number of remaining fungi was found in the test pieces treated in the working examples of this invention, whereas the degree of discoloration was high and the number of remaining fungi was large in the test pieces treated in the comparative experiment by the conventional method. It is further noted that in the working examples of this invention, the amounts of chloramine liberated during the treatment were very small.

EXAMPLE 3

Test pieces from a hide suffering from fungous growth were treated by following the procedure of Example 2, except that trichloroisocyanuric acid was used as the chlorinated isocyanuric acid and a varying organic solvent indicated in Table 2 was used in place of acetone. At the same time, the test pieces were tested for degree of discoloration, number of remaining fungi, amount of chlorine remaining in the solution, and amount of chloramine liberated during the treatment. The results were as shown in Table 2.

TABLE 2

| Test Run No. | Solvent | Concentration of active chloride (ppm) | Discoloration by fungi | Number of remaining fungi after treatment | Amount of chlorine remaining after treatment (ppm) | Amount of chloramine liberated during treatment (mg) |
|---|---|---|---|---|---|---|
| 12 | Methylethyl ketone | 10,000 | ◎ | 0 | 1000 | 0.8 |
| 13 | Ethyl acetate | 10,000 | ◎ | 0 | 2500 | 0.9 |
| 14 | Trichloroethane | 200 | ○ | $3 \times 10^2$ | 150 | not more than 0.1 |
| 15 | Tetrachloroethylene | 200 | ○ | $5 \times 10^2$ | 170 | no more than 0.1 |

In Table 2 above, in Test Runs 14 and 15 which used trichloroethane and tetrachloroethylene respectively as the solvent, the numbers of fungi remaining after treatment was rather large because the concentration of active chlorine was low. In such cases, better results comparable to those of Example 2 would have been obtained by either lengthening the periods of treatment or heightening the temperatures of treatment. In Test Runs 12 and 13 which used methylethyl ketone and ethyl acetate respectively as a solvent, excellent results were obtained.

What is claimed is:

1. A method for the removal of fungi from a hide suffering from fungous growth, comprising subjecting the hide to immersion in a solution containing chlorinated isocyanuric acid or salt.

2. The method according to claim 1 wherein the said solution is an aqueous solution.

3. The method according to claim 1 wherein the said solution comprises an organic solvent.

4. The method according to claim 2 wherein the immersion of the hide is made in an aqueous solution of an alkali metal salt or an alkaline earth metal salt of chlorinated isocyanuric acid.

5. The method according to claim 4 wherein the treatment is made in an aqueous solution of an alkali metal salt of dichloroisocyanuric acid containing active chlorine in a concentration of 0.01 to 20 percent.

6. The method according to claim 5 wherein the active chlorine is present in a concentration of 0.1 to 10 percent.

7. The method according to claim 3 wherein said solution comprises chlorinated isocyanuric acid dissolved in a halogenide of an aliphatic hydrocarbon having one to three carbon atoms.

8. The method according to claim 3 wherein said solution comprises chlorinated isocyanuric acid dissolved in a ketone or ester represented by the general formula:

$$R_1-\overset{\overset{\displaystyle O}{\|}}{C}-R_2$$

(wherein $R_1$ denotes an alkyl group having one to three carbon atoms and $R_2$ an alkyl group or alkoxy group having one to three carbon atoms).

9. The method according to claim 7 or 8 wherein said chlorinated isocyanuric acid is present in a concentration of 0.01 to 20 percent as active chlorine.

10. The method according to claim 9 wherein said chlorinated isocyanuric acid is present in a concentration of 0.01 to 10 percent as active chlorine.

* * * * *